United States Patent [19]

Schaedel

[11] 4,152,221

[45] May 1, 1979

[54] ANODIZING METHOD

[75] Inventor: Fred C. Schaedel, Cypress, Calif.

[73] Assignee: Nancy Lee Kaye, Redondo Beach, Calif.

[21] Appl. No.: 832,405

[22] Filed: Sep. 12, 1977

[51] Int. Cl.[2] ..... C25D 11/08; C25D 11/10; C25D 11/16

[52] U.S. Cl. ..... 204/27; 204/28; 204/33; 204/58

[58] Field of Search ..... 204/15, 224 R, 58, 228, 204/DIG. 9, 27–28, 33

[56] References Cited

U.S. PATENT DOCUMENTS

| | | | |
|---|---|---|---|
| 1,416,929 | 5/1922 | Bailey | 204/224 R |
| 1,735,286 | 11/1929 | Kojirai et al. | 204/58 |
| 1,869,042 | 7/1932 | Bengston | 204/58 |
| 2,540,602 | 2/1951 | Thomas et al. | 204/224 R |
| 2,901,412 | 8/1959 | Mostovych et al. | 204/58 |
| 2,963,409 | 12/1960 | Ramirez | 204/58 |
| 3,038,850 | 6/1962 | Wagner | 204/28 |
| 3,146,178 | 8/1964 | Cochran et al. | 204/58 |
| 3,275,537 | 9/1966 | Petin | 204/58 |
| 3,280,013 | 10/1966 | Economy | 204/58 |
| 3,294,666 | 12/1966 | Wiersma | 204/224 R |
| 3,546,088 | 12/1970 | Barkman et al. | 204/224 R |
| 3,857,766 | 12/1974 | Woods | 204/58 |
| 3,909,387 | 9/1975 | Kolic et al. | 204/28 |

FOREIGN PATENT DOCUMENTS

| | | | |
|---|---|---|---|
| 48-12307 | 4/1973 | Japan | 204/28 |
| 49-25540 | 7/1974 | Japan | 204/28 |
| 455412 | 10/1936 | United Kingdom | 204/58 |
| 466941 | 6/1937 | United Kingdom | 204/58 |
| 727749 | 4/1955 | United Kingdom | 204/58 |
| 1159392 | 7/1969 | United Kingdom | 204/58 |

OTHER PUBLICATIONS

Electroplating Eng. H. Book, 2nd Ed., by A. K. Graham et al., 1962, pp. 670–671.

Surface Treatment of Al, by Wernick et al., 3rd Ed., 1964, p. 316.

*Primary Examiner*—R. L. Andrews

*Attorney, Agent, or Firm*—Thomas A. Fournie

[57] ABSTRACT

Anodizing apparatus and method suitable for anodizing an aluminum part by a continuous process wherein the part is moved through adjacent processing regions to sequentially clean, anodize, rinse, reanodize, rerinse and dry same. The anodizing regions form anodizing cells wherein an unbroken anodizing current conducting envelope of electrolyte is formed around the part. In order to produce a hard anodized aluminum product, the electrolyte may be refrigerated or contain a selective additive. The selective additive may be formed of hydroxyacetic, carboxylic or hydroxydicarboxylic acids combined with an alcohol or triethanolamine. A surfactant may also be included in the electrolyte to form an oxygen holding foam around the part portion being anodized. Circuitry is provided to supply voltage pulses of the same polarity across the electrodes of the two anodizing cells on a time sharing basis and the voltage pulses are selectively controlled to set the average anodizing current density in each of the cells at a selected predetermined RMS value. The sprayed electrolyte is collected, recirculated and refrigerated, and reused in the apparatus.

37 Claims, 10 Drawing Figures

ANODIZING METHOD

BACKGROUND OF THE INVENTION

The present invention relates to anodizing as well as the production of anodized aluminum.

The term anodized aluminum as here used refers to aluminum and its alloys which have been subjected to the anodizing process to produce adherent aluminum oxide ($Al_2O_3$) coatings thereon. Such aluminum oxide coatings provide hard and strong protective coatings for the soft surface of aluminum and its alloys and are formed on parts made of aluminum and its alloys to protect same against corrosion and abrasion, to strengthen such parts, to provide electrical insulation thereon, and in some instances for the purpose of providing decorative effects.

Heretofore, the typical manner by which an aluminum or aluminum alloy part has been anodized has been to immerse the part in a tank containing an anodizing electrolyte, such as sulfuric acid, sulfamic acid, oxalic acid, chromic acid or phosphoric acid, and causing a continuous direct current (DC) to flow through the electrolyte between the part and the tank, the part being the anode in this electrolytic cell formed and the tank being the cathode. Further, it has been found that by refrigerating the electrolyte to lower its temperature from ambient temperature, i.e. 68°–72° F., to a relatively cold temperature, the hardness of aluminum oxide coating formed on the part is increased. Accordingly, the anodizing process conducted with the refrigerated or cold electrolyte has been commonly referred to as hard anodize.

The above-discussed prior art anodizing process has several drawbacks. Firstly, since the aluminum or aluminum alloy part has to be immersed in the electrolyte, the tank has to be at least as long as the part. Thus, to anodize long parts, long tanks have to be built and to hard anodize such long parts a substantial quantity of electrolyte must be refrigerated. These requirements make the cost of hard anodizing long parts quite expensive. Additionally, it is apparent that it is inefficient to use a relatively long tank for hard anodizing a short part since energy will be wasted, for example, in refrigerating the large quantity of electrolyte contained in the long tank. Thus, it may be necessary to custom make anodizing tanks and custom design refrigeration plants to handle specific parts to be anodized which have different lengths. All this is costly.

Secondly, the prior art anodizing process has the disadvantage of not being suited for use in a continuous process system. Since the part to be anodized is totally immersed in the electrolyte, no other work can be simultaneously performed on the part while it is being anodized.

Additionally, the thickness of the aluminum oxide coating which presently can be produced by the prior art anodizing process is relatively thin while the power and time consumed in producing same is relatively high. Also, the prior art anodizing process has the disadvantage that the current density of the DC anodizing current is relatively restricted and must be carefully controlled in order to avoid burning of the part being anodized. As a consequence, since the electrical resistance of the part to the anodizing current flow increases as the thickness of the aluminum oxide coating formed thereon increases, the DC voltage applied to cause the flow of anodizing current therethrough must be gradually increased from a relatively low level in a controlled manner during the anodizing process in order to insure the formation of the aluminum oxide coating without burning. As a consequence, it has generally been necessary to employ a skilled operator to monitor and control the operation of the prior art process.

SUMMARY OF THE INVENTION

It is an object of the present invention to provide an improved anodizing method and apparatus.

It is an object of the present invention to provide an improved method and apparatus for producing anodized aluminum which obviates the disadvantages and drawbacks of the prior art hereinbefore mentioned.

It is additionally an object of the present invention to provide an improved method and apparatus for producing anodized aluminum which utilizes the concept of forming an unbroken envelope of anodizing electrolyte to obviate the prior art requirement of immersing the part to be anodized in a pool of anodizing electrolyte filling a tank, thereby to eliminate the need and coat associated with building specific length anodizing tanks to handle specific length parts.

It is further an object of the present invention to provide an improved method and apparatus for producing anodized aluminum which is characterized by being capable of producing aluminum oxide coatings of greater thickness than the prior art by the use of relatively less power.

It is also an object of the present invention to provide an improved method and apparatus for producing anodized aluminum which is characterized by being capable of producing aluminum oxide coatings of greater thickness than the prior art at a relatively rapid rate.

It is another object of the present invention to provide an improved method and apparatus for producing anodized aluminum which is characterized by using voltage pulses to produce the anodizing current with the presently unexplained result that elevated current densities can be used to produce the aluminum oxide coating without burning or destroying the part to be anodized.

It is yet another object of the present invention to provide an improved method and apparatus for continuously processing an aluminum or aluminum alloy part of virtually any length to anodize same.

It is still another object of the present invention to provide an improved method and apparatus for continuously anodizing aluminum characterized by utilizing a plurality of anodizing cells for the processing of each part which are each powered by a single power source, the single power source being operable to supply selectively controlled voltage pulses to each anodizing cell.

It is further an object of the present invention to provide an improved method and apparatus for producing anodized aluminum which is characterized by being surprisingly and unexpectedly efficient, inexpensive, effective and space saving.

It is another object of the present invention to provide an improved method and apparatus as hereinabove set forth characterized by being capable of producing hard anodized aluminum.

It is also an object of the present invention to provide an improved method and apparatus for producing hard anodized aluminum which is characterized by consuming substantially less power than the prior art, both for coating and refrigeration, if refrigeration is employed.

It is yet another object of the present invention to provide an improved method and apparatus as hereinabove set forth characterized by being capable of producing hard anodized aluminum by utilizing either refrigerated anodizing electrolyte or utilizing the anodizing electrolyte at ambient temperature with a selected additive added thereto.

In accomplishing these and other objects, there is provided anodizing apparatus suitable for anodizing an aluminum or aluminum alloy part of virtually any length by a continuous process. In the exemplary apparatus hereinafter described, the part is continuously moved through a series of adjacent processing regions at a controlled rate to be sequentially cleaned, anodized to form a coating of aluminum oxide $Al_2O_3$ thereon, rinsed, reanodized to thicken the $Al_2O_3$ coating, rerinsed and dried. As the part is moved through these processing regions, different portions of the part will be simultaneously in different ones of the processing regions.

The two processing regions which form the $Al_2O_3$ coating constitute anodizing cells in which the part operates as the anode. The anodizing cells include spray nozzle systems which spray electrolyte in a continuous unbroken envelope over and around the portion of the part therein. The spray nozzles operate as the cathode of the anodizing cells and the unbroken electrolyte envelope operates as the anodizing current path between the cathode and anode. In order to produce a hard anodized aluminum product, the electrolyte may be refrigerated or contain a selected additive. The selected additive may be formed of hydroxyacetic acid, carboxylic acid, dicarboxylic acid and hydroxy derivatives of these acids combined with either an alcohol or triethanolamine, as hereinafter described.

Circuitry is provided to supply voltage pulses of the same polarity across the electrodes of the two anodizing cells on a time sharing basis and the duration and magnitude of the voltage pulses are selectively controlled to set the anodizing current density in each of the cells at a selected predetermined level, such as a root mean square value (RMS) of 70 amperes per square foot (ASF).

In order to produce more oxygen adjacent the surface of the part being anodized, a surfactant is preferably added to the anodizing electrode. The surfactant causes foam containing oxygen to be produced around the part. For this same purpose, air and/or carbon dioxide $CO_2$ may be injected into the electrolyte spray. The nozzles spraying the electrolyte are arranged to produce the continuous unbroken spray envelope around the part moving through the anodizing cells and may be shaped to produce cone or crescent shaped spray patterns.

The electrolyte is preferably a dilute sulfuric acid solution containing 15–25% sulfuric acid by volume and 3–10% by volume of the surfactant. The surfactant is preferably a lignin wood sulfonate solution formed by mixing Orzan S concentrate with water in the approximate proportions of 100 grams of the concentrate per each gallon of water. Orzan S is a lignin wood sulfonate which is compatible with sulfuric acid. The electrolyte, after being sprayed on the part, is collected, recirculated and refrigerated and then reused.

Additional objects of the present invention are embodied in the construction of the aluminum anodizing system and apparatus hereinafter described in conjunction with the several drawing figures as well as its method of operation.

DETAILED DESCRIPTION OF THE PREFERRED EMBODIMENT

Figure 1:
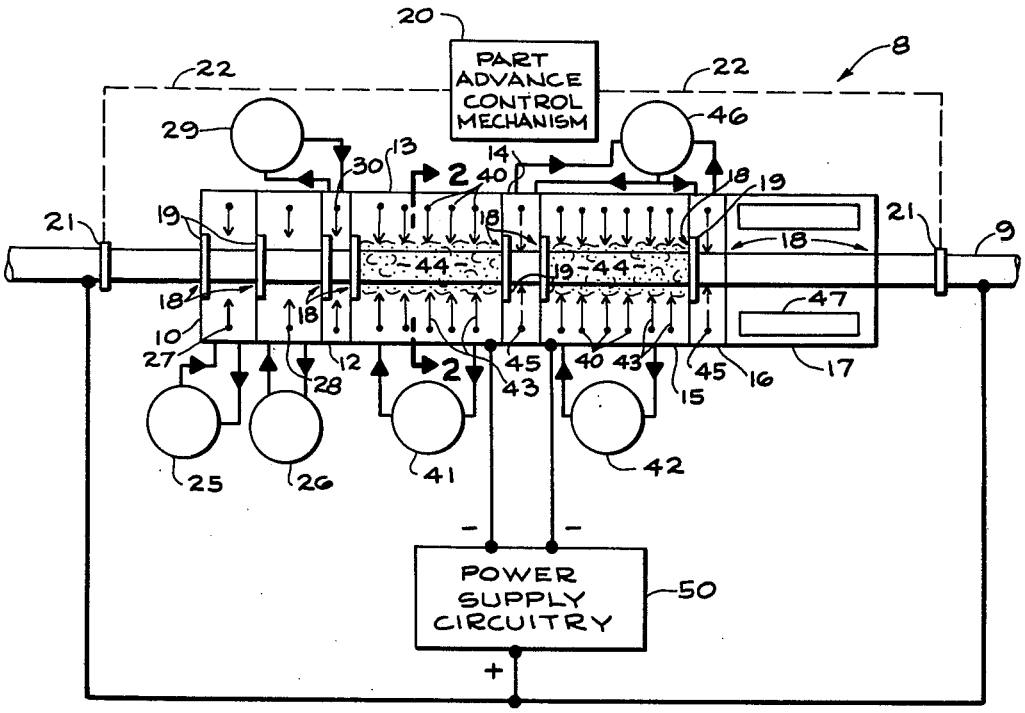
FIG. 1 is a plan view of an apparatus for producing anodized aluminum according to the present invention.

Referring to the drawings, there is shown in FIG. 1 an apparatus or system generally identified by the numeral 8 for anodizing an aluminum or aluminum alloy part of virtually any length by a continuous process. The apparatus 8 is shown processing part 9 which is a boat mast made of aluminum alloy.

The apparatus 8 illustrated is made up of a series of adjacent processing regions or chambers which are illustrated defined as upwardly opening tanks 10–17. The tanks 10–17 have longitudinally aligned holes 18 formed in their ends and adjacent their upper edges through which the longitudinal part 9 may be moved and extend as shown in FIG. 1. Certain of the tanks 12–17 have movable flaps 19 covering the holes 18 to prevent spray from one tank being sprayed into its adjacent tank.

As shown in FIG. 1, the part 11 is moved through the processing regions 10–17 by conventional part advance control mechanism 20. The advance control mechanism 20 is connected by coupling arrangements 21 to selected points on the part 9 and operates through the mechanical connection 22, shown by dashed lines, to move the part gradually at a controlled rate through the processing regions 10–17. The rate at which the part 9 is selectively advanced may be selectively set by appropriately setting the control mechanism 20. The mechanism 20 may be conveyor mechanism and a typical rate of part advance may, for example, be one to two inches per minute.

As illustrated by FIG. 1, the length of the part 9 being processed is substantially longer than the entire anodizing system 8 and may be any length. For example, in an apparatus 8 built in accordance with the present invention used to anodize parts 30–35 feet in length, the overall length of the apparatus was 15 feet with the length of its anodizing chambers being 2 or 4 feet.

The processing regions defined by the tank 10–11 are cleaning chambers wherein the part 9 is cleaned in a conventional manner prior to anodization. The tanks 10–11 act as collecting tanks and conventional pumps 25, 26 and spray systems 27, 28 are shown associated therewith for spraying the part with cleaning solutions. In FIG. 1, the input and return lines of the pumps shown therein are identified by directional arrows associated therewith. In the cleaning chamber 10, the part 9 is cleaned of foreign matter by being sprayed with a conventional alkaline cleaning agent. In the chamber 11, the surface of the part 9 is deoxidized by spraying with a conventional deoxidizing agent, such as a mixture of chromic and nitric acids.

After being cleaned in the cleaning chambers 10 and 11, the part 9 is rinsed with water in rinse chamber 12. A conventional pump 29 and spray system 30 is provided for this purpose.

the processing chambers 13 and 15 define the anodizing cells and situated therebetween is a rinse chamber 14.

The anodizing cells 13 and 15 may be identically constructed. Each has associated therewith a spray nozzle system 40 of the type shown in FIG. 3 which operates in conjunction with a combination pump-refrigeration system 41, 42 to form an unbroken envelope of anodizing electrolyte 43 around the part 9 as it traverses the anodizing regions 13 and 15. It is essential that the envelope of electrolyte 43 formed around the part 9 is unbroken since the anodizing current flows through the electrolyte envelope from the part 9 to the spray nozzles 40 and tanks 13 and 15. As shown in FIG. 1, the tanks 13 and 15 operate as the cathode in the anodizing cell since they are connected to the negative terminal of the power supply 50 while the part 9 acts as the anode. The part 9 is connected to the positive terminal of the power supply circuit 50. The nozzles 40 are electrically connected to the tanks 13 and 15 so as to all function therewith as the anodizing cell cathodes.

Figure 2:
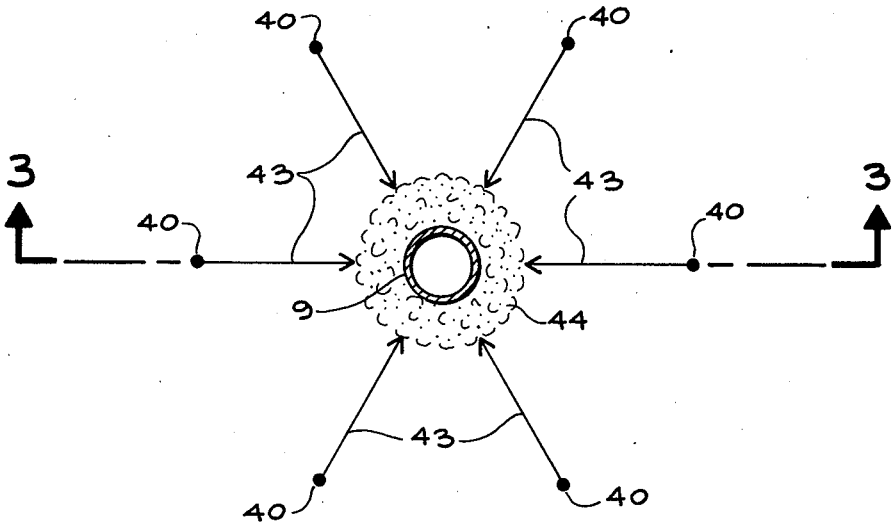
FIG. 2 is a view taken along the line 2—2 of FIG. 1.
Figure 3A:
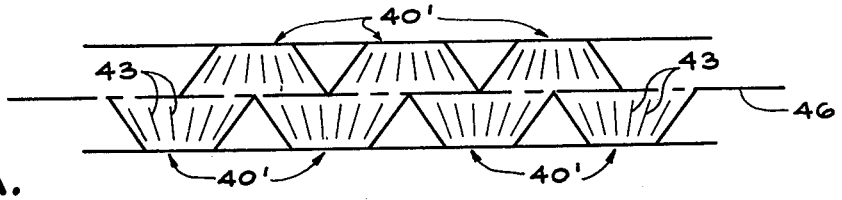
FIG. 3A is a view taken along the line 3—3 of FIG. 2 illustrating one suitable spray pattern for forming the unbroken envelope of anodizing electrolyte in the anodizing cells around the part to be anodized.
Figure 3B:
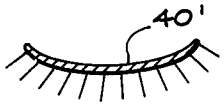
FIG. 3B is a cross-sectional view of a spray nozzle suitable for use in producing the spray pattern of FIG. 3A.

The general direction the electrolyte 43 is sprayed by the nozzles 40 is indicated by arrows in FIG. 2. As there shown, sets of nozzles 40 are positioned circumferentially and symmetrically around the part 9 so that an electrolyte envelope is formed completely therearound. As shown in FIGS. 3A and 3B, the unbroken electrolyte envelope may be formed by using the type of nozzles identified by the numeral 40' to direct conical spray patterns against opposite sides of the part 9. Preferably, the nozzles 40' are offset longitudinally along the path of travel 46 of the part to form the overlapping spray pattern shown in FIG. 3A. A front view of the type of spray nozzle 40' is shown in FIG. 4A.

Figure 4A:
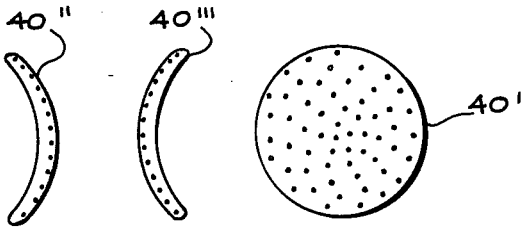
FIG. 4A illustrates a combination of spray nozzles also suitable for forming the unbroken envelope of anodizing electrolyte in the anodizing cells around the part to be anodized.
Figure 4B:
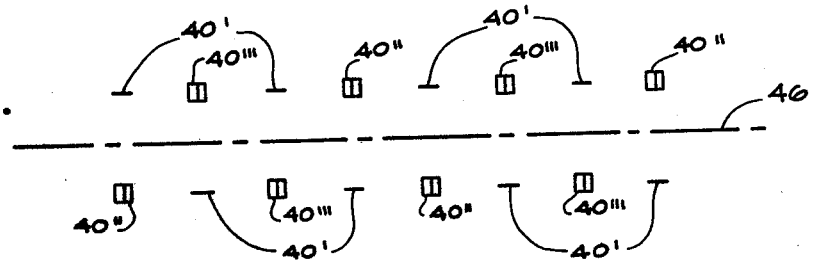
FIG. 4B is a view taken in the same plane as FIG. 3A illustrating a suitable disposition for the spray nozzles of FIG. 4A to form the unbroken envelope of anodizing electrolyte around the part to be anodized.

Alternately, the combination of nozzle types shown in FIG. 4A may be used to form the unbroken electrolyte envelope. As mentioned above, a front view of the spray nozzle type 40' is there shown. Also shown are front views of crescent shaped nozzles 40'' and 40''', which are the mirror image of each other. The crescent shaped nozzles 40'' and 40''' spray electrolyte in patterns having cross-sections substantially corresponding to their shapes. As earlier mentioned, the nozzle 40' sprays a conically shaped pattern. A suitable disposition for the combination of nozzles shown in FIG. 4A effective to form an unbroken electrolyte envelope around the path of travel of the part 46 is illustrated in FIG. 4B.

The electrolyte 43 employed may be any suitable anodizing electrolyte, such as sulfuric acid, sulfamic acid, oxalic acid, chromic acid or phosphoric acid. Preferably, however, the anodizing electrolyte is a dilute sulfuric acid solution containing 15–25% acid by volume. In the apparatus 8, the sulfuric acid anodizing electrolyte is pumped, sprayed, recirculated and may be refrigerated by the pumping and refrigerating equipment identified by the numerals 41 and 42. If refrigerated, the electrolyte is preferably cooled to have a temperature in the range of 25°–35° F. so that the anodization performed by the apparatus 8 produces a hard anodized aluminum product.

Alternately, it has been found that the apparatus 8 can produce hard anodized aluminum product utilizing ambient temperature anodizing electrolyte 43 in the 60°–70° F. temperature range if a selected additive is added to the anodizing electrolyte. The selected additive may be formed by a combination of first and second components or ingredients. The first component may be hydroxyacetic, carboxylic or hydroxydicarboxylic acid. Suitable known acids are asparatic acid, lactic acid, glycine, succinic acid and glutaric acid, each of these acids being characterized by having carboxyl groups in the first and second positions. The second component may be either triethanolamine or alcohol. Known suitable alcohols are glycerin, mannitol and sorbital, each of these alcohols being a heavy complex alcohol. Another suitable acid for the first component is an acid sold under the trade name of FE3 Specific which is n,n dihydroxyethyl glycine.

The concentration of this additive in the electrolyte 43 should be in the range of 4%–10% by volume, with a preferred range being 5%–7% by volume. The additive is preferably made by combining equal parts of the first and second components to form same. At the time of filing this specification, hydroxyacetic acid is preferred for use as the first component and glycerin as the second component. The acid n,n dihydroxyethyl glycine is also preferred for use as the first component.

The electrolyte 43 also preferably contains a compatible surfactant. The concentration of the surfactant in the dilute sulfuric acid electrolyte should preferably be in the range of 3%–10% by volume. A compatible and suitable surfactant for use with the sulfuric acid electrolyte above-mentioned is a lignin wood sulfonate solution formed by mixing Orzan S concentrate with water in the approximate ratio of 100 grams of Orzan S to each gallon of water. Orzan S is a lignin wood sulfonate. The surfactant acts as a surface acting wetting agent which forms a complex with the part 9 being processed to produce therearound an oxygen holding foam 44. The foam 44, which is identified in FIGS. 1 and 2, provides available oxygen to aid in the formation of the aluminum oxide coating $Al_2O_3$ on the part surface.

Additionally, air and/or carbon dioxide $CO_2$ may be added to the electrolyte to aid the formation of the foam 44 and produce more oxygen therein.

As hereinafter discussed, the power supply circuitry 50 operates to supply voltages pulses of the same polarity across the electrolytes of the two anodizing cells 13 and 15 on a time shared basis, and the duration and magnitude of the voltage pulses are selectively controlled to set the anodizing current density in each of the cells at a selected predetermined level. The current density level of an RMS value of approximately 70 ASP has been found suitable.

In this manner, the cleaned portion of the part 9 moving from the rinse chamber 12 is continuously processed by being anodized in the anodizing cell 13 to form an $Al_2O_3$ coating thereon, rinsed in the rinse chamber 14 to wash the corrosive sulfuric acid therefrom, reanodized in the second anodizing cell 15 to thicken the $Al_2O_3$ coating and rerinsed in the rinse chamber 16. It is noted that the rinse chambers 14 and 16 are similarly constructed, each having spray nozzles 45 and a pump 46 which pumps water thereto to rinse the part 9. Once the part is rinsed in the chamber 16, it is moved through region 17 which constitutes a drying chamber. The drying chamber 17 may contain heating elements, a forced air drying system or any other suitable system, generally identified by the numeral 47, for drying the surface of the anodized part 9. The part 9 may then be dyed or treated in another conventional manner.

It is noted that the provision of the flaps 19 around the exits holes of the anodizing cells 13 and 15 have the effect of extending the cell lengths slightly, such as three inches, since the unbroken electrolyte envelope extends thereunder the distance the flaps are bent forwardly by the movement and presence of the part 9. It is also noted that the term unbroken electrolyte envelope is used herein to mean that a continuous electrical currrent path is maintained therethrough for anodizing current flow from the spray nozzles 40 to the part 9.

It is also noted that while a plurality of two anodizing cells 13 and 15 are shown in the apparatus 8 that additional anodizing cells could be included in the system. The advantage gained by utilizing a plural number of anodizing cells is that as the thickness of the $Al_2O_3$ coating is built up the RMS voltage magnitude of the same polarity voltage pulses applied to the part in each cell can be increased selectively from cell to cell to account for the increased coating thickness and thereby the average anodizing current in each cell can be maintained substantially constant at the selected optimum level.

Figure 5:
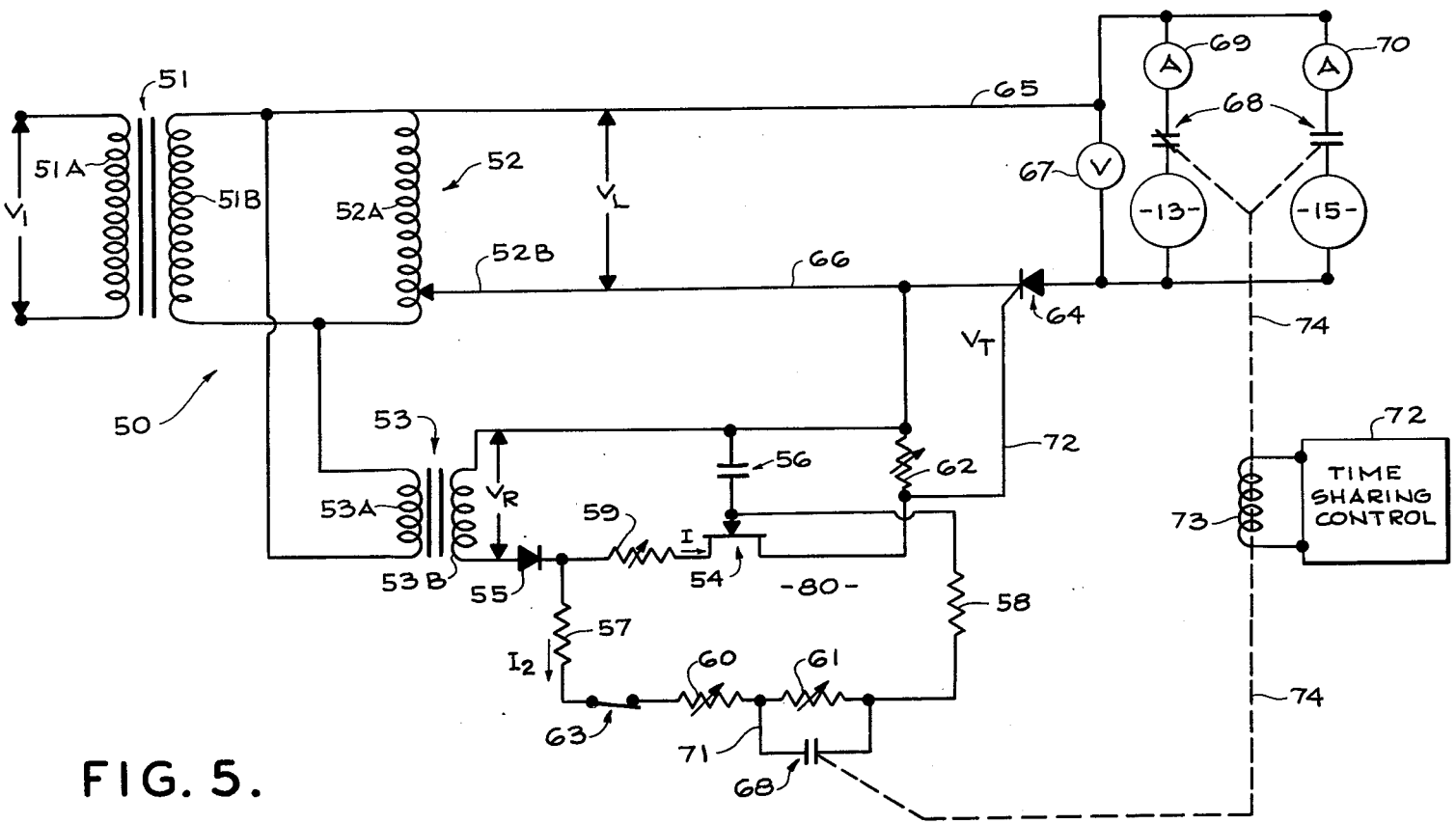
FIG. 5 is a circuit diagram of the power supply circuitry of FIG. 1.

Referring now to FIG. 5, the circuitry 50 supplying the power to the anodizing cells 13 and 15 to generate the anodizing current therein is shown.

The circuit 50 includes a power transformer 51 having primary and secondary coils 51A and 51B; a percent power output transformer 52 having output coil 52A connected in parallel with secondary coil 51B and an adjustable output pickoff 52B; a control transformer 53 having its primary coil 53A connected in parallel with coil 52A and having a secondary coil 53B; a relaxation oscillator 80 formed by unijunction transistor 54, diode 55, capacitor 56, fixed resistors 57–58, variable resistors 59-62 and an on-off switch 63; and a silicon control rectifier (SCR) 64.

The output signal of transformer 52 is supplied to voltage buses 65 and 66. The bus 66 has SCR 64 connected with its base to emitter current path in series therewith, the base electrode of the SCR being connected to the bus 66. Connected in parallel between the voltage bus 65 and the emitter electrode of the SCR 64 are the following; an RMS voltmeter 67; the load provided by the anodizing cell 13 in series with normally closed contacts of control relay switch 68 and an ammeter 69; and the load provided by the anodizing cell 15 in series with normally open contacts of the switch 68 and an ammeter 70. Additionally, a shunt 71 containing normally open contacts of the switch 68 is connected across the variable resistor 61. The output of the relaxation oscillator 80 which is generated on lead 72 is connected to the control electrode of the SCR 64. Time sharing control mechanism 72 is also shown which operates to control the control relay switch 68, thereby to control the time period during which each anodizing cell 13, 15 is connected as the load of the power circuit 50. The control 72 has its output connected to the relay coil 73 of the switch 68 and the interconnection between the movable coil of the relay 73 and the switch contacts is indicated by the dashed lines 74.

In operation of the circuit 50, AC input power $V_1$ is received on the primary of transformer 51 and converted thereby into two in-phase AC signals, i.e. $V_L$ and $V_R$. The first AC signal $V_L$ appears across the voltage buses 65 and 66 and is for generating the anodizing currents through the loads provided by the anodizing cells 13 and 15. No voltage signal across the buses 65 and 66, however, can appear across either anodizing cell until the SCR 64 is triggered into conduction. The second AC signal $V_R$ appears on the transformer secondary 53B and drives the relaxation oscillator circuit 80 provided by the unijunction transistor 54. The relaxation oscillator 80 is adjustable to produce trigger pulses at a predetermined selected time during a selected half of each cycle of the signal $V_L$ and also can be adjusted to produce no trigger pulses.

The operation of the relaxation oscillator 80 is first described with the contacts of the switch 68 assumed to be as shown in FIG. 5. The diode 55 acts as half-wave rectifier and the half of the AC signal $V_R$ which biases the diode 55 into conduction will cause a current $I_1$ to flow through the current path defined by the variable resistors 59, 62 and the base current path of the unijunction transistor 54. As a consequence during this half wave of the signal $V_L$, a voltage $V_T$ will appear on lead 72 which corresponds to the Instantaneous magnitude of the voltage $V_R$ and the ratio between the resistances 59 and 62. The values of these resistances 59 and 62 are appropriately adjusted so that the voltage $V_T$ at all times remains below the level necessary to trigger the SCR 64 into conduction.

Simultaneously, the signal $V_R$ is causing a current $I_2$ to flow through the fixed resistor 57; closed switch 63; variable resistors 60, 61; and fixed resistor 58 to charge the capacitor 56. The capacitor 56 will charge until the emitter electrode junction of the unijunction 54 becomes forwarded biased whereupon the capacitor 56 discharges through the forwarded biased junction of the unijunction 54 and the resistor 62 to increase the voltage $V_T$ to a level sufficient to trigger the SCR 64 into conduction. As a consequence, the instantaneous signal $V_L$ is now applied across the load provided by anodizing cell 13 and an anodizing current flow is generated therein. Such a charging and discharging of the RC circuit containing the capacitor 56 constitutes a cycle of the RC circuit.

The circuit 50 operates in the same manner above-described to generate an anodizing current in the anodizing cell 15 whenever the solenoid 73 is energized to close the normally open contacts of the switch 68 and open its normally closed contacts. In such case, the anodizing cell 15 is connected as the load of the circuit 50 and the variable resistor 61 is shunted out of the oscillator 80 by the shunt 71.

In operation of the apparatus 10, the time sharing control 72 is generally set to alternately connect the anodizing cells 13 and 15 as the load of the circuit 50, each for fifty percent of the time. Generally, the time period during which each anodizing cell is connected in the circuit 50 as a load is substantially longer than the time period of a cycle of the AC signal $V_L$.

The speed at which the capacitor 56 charges to a level sufficient to forward bias the emitter junction of the unijunction 54 is determined by the time constant of the R-C circuit formed by the resistors 57, 60, 61, 58 and the capacitor 56. The lower the resistance, the quicker the SCR is triggered into conduction and the higher the RMS value of the voltage that will be applied across the anodizing cell. This RMS voltage applied is monitored by the voltmeter 67, and the time constant provided the aforementioned R-C circuit is adjustable in the range from substantially zero to a time equal to one-half of a cycle of the voltage signal $V_L$.

As earlier mentioned herein, it is desirable to maintain a predetermined anodizing current density through each of the anodizing cells 13 and 15. With regard to the cell 15, this is accomplished by monitoring the RMS current reading on the ammeter 70 and adjusting the variable resistor 60 until the ammeter reads a desired level. If for example, the desired current density is 70 ASF, the reading on the ammeter, if in amperes, should equal 70 times the area in square feet of the portion of the part 9 being anodized in the anodizing cell 15. Similarly with the anodizing cell 13, the current density therein may be selectively set by monitoring the ammeter 69 and selectively adjusting the variable resistor 61.

It is noted that since the aluminum oxide coating formed in anodizing cell 13 is always less thick than the coating in cell 15 that not as much of the $V_L$ voltage signal will be needed to generate the desired level anodizing current in cell 13 as in cell 15. Hence, the charging time for the capacitor 56 associated with the cell 13 should always be greater than that of cell 15. Thus, by adjusting variable resistor 60 to set the current density in cell 15 and then keeping the resistor 60 setting constant and varying the resistor 61 setting to set the current density in cell 13, the apparatus can be set to maintain the proper current density in each anodizing cell. As shown in FIG. 5, when the cell 13 is the load on the circuit 50 the resistor 61 is switched in the charging circuit and when the cell 15 is the load the resistor 61 is shunted out.

Figure 6A:
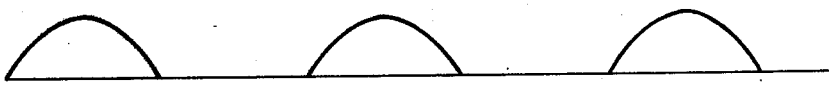
FIGS. 6A, 6B and 6C are views, respectively, of the complete voltage wave $V_L$ available for generating anodizing current, a portion thereof applied across a first anodizing cell and a greater portion thereof applied across a second anodizing cell.
Figure 6B:
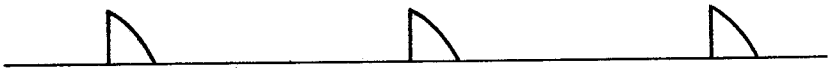
Figure 6C:
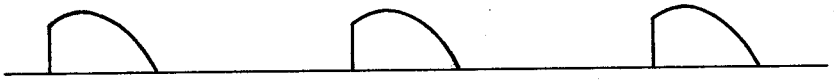

FIG. 6A illustrates the whole half of the voltage wave $V_L$ which would be applied across an anodizing cell if the SCR 64 were biased into conduction throughout the entire half-wave. FIG. 6B illustrates a typical portion of this voltage wave which may be applied across the cell 13 by setting resistor 61. FIG. 6C illustrates a greater amount of the half-wave $V_L$ which would be typically applied across the cell 15 by appropriately setting the resistor 60.

It is noted that with the resistors 60 and 61 adjusted to give zero resistance that the time constant of the R-C circuit provided by resistors 57, 58 and capacitor 56 should be practically negligible in comparison to the time duration of one-half wave of the AC signal $V_L$ so that the SCR 64 will be biased into conduction for essentially the entire half-wave. Further, the resistors 60 and/or 61 when adjusted to full resistance should be capable of establishing a time constant equal to the time duration of a half-wave of the signal $V_L$ so that under such a setting the SCR would never be biased into conduction. For example, with a sixty cycle per second AC signal, the time duration of one-half wave length is approximately 0.0083 seconds. Thus, the time constant of the charging circuit for the capacitor 56 should be adjustable in the range from approximately 0 seconds to 0.0083 seconds.

With the apparatus 8 of the present invention, it has been found that plant size can be reduced by about 75%, the time for processing a part can be reduced by approximately 50%, that an aluminum oxide coating of given thickness and hardness can be produced in about half the time utilizing much less power and voltage, and that higher anodizing current densities can be used without burning the parts being anodized.

Although the invention has herein been described in a preferred embodiment, it is recognized that departures may be made therefrom within the scope of the claims.

I claim:

1. A continuous spray process for hard anodizing the outer peripheral surface of an anodizable part, comprising: utilizing an anodizing electrolyte containing a surfactant compatible therewith; transferring said part at a controlled rate through a selected spray pattern of said anodizing electrolyte containing said surfactant, said spray pattern being effective to form completely around the outer peripheral surface of said part as same is transferred therethrough an unbroken envelope of anodizing electrolyte and said surfactant in said anodizing electrolyte being effective to form an oxygen containing foam over the outer peripheral surface of said part as same is transferred through said spray pattern; and causing an anodizing current to flow through said unbroken electrolyte envelope and oxygen containing foam, said anodizing current being formed by a series of electrical pulses of the same polarity the duration and magnitude of which are selectively controlled to establish an anodizing current density over said surface having a predetermined average RMS value thereby to produce a hard, thick and uniform anodic coating on said surface.

2. The process of claim 1, wherein said part is made of aluminum or an aluminum alloy; said anodizing electrolyte is dilute sulfuric acid; and said surfactant is a liginin wood sulfonate solution.

3. The process of claim 2 wherein said anodizing electrolyte contains a selected additive consisting essentially of first and second components, said first component is a compound selected from the group consisting of hydroxyacetic acid, carboxylic acids and hydroxydicarboxylic acids, said second component is a compound selected from the group consisting of triethanolamine and alcohols.

4. The process of claim 3, wherein the concentration of said additive in said anodizing electrolyte is in the range of 4–10% by volume;

said carboxylic and hydroxydicarboxylic acids have carboxyl groups in the first and second positions and include aspartic acid, lactic acid, glycine, succinic acid and glutaric acid; and said alcohols are heavy complex alcohols and include glycerin, mannitol, and sorbitol.

5. The process of claim 4, wherein said anodizing electrolyte contains 15–25% sulfuric acid by volume and 3–10% of said lignin wood sulfonate solution by volume.

6. The process of claim 4, wherein said additive is formed by mixing substantially equal parts of said first and second components;

said first component is hydroxyacetic acid;

said second component is glycerin; and the concentration of said additive in said anodizing electrolyte is in the range of 5–7% by volume.

7. The process of claim 2, wherein said anodizing electrolyte contains 15–25% sulfuric acid by volume and 3–10% of said lignin wood sulfonate solution by volume, said lignin wood sulfonate solution being formed by mixing lignin wood sulfonate concentrate with water in the approximate ratio of 100 grams of said concentrate to each gallon of water.

8. The process of claim 1, wherein said continuous process includes repeatedly anodizing the outer peripheral surface of said part by the process of claim 1, the duration and magnitude of the series of electrical pulses of the same polarity forming said anodizing current in each repeated anodization of said part being selectively controlled to increase their RMS voltage level from one hard anodization to the next to maintain as the hard anodic coating on the outer peripheral surface of said part increases in thickness from one anodization to the next an anodizing current density over said surface having substantially the same predetermined average RMS value whereby the hard, thick and uniform anodic coating formed on the outer peripheral surface of said part may be increased in such a controlled manner until a predetermined thickness is reached.

9. The process of claim 8, wherein: said anodizing electrolyte contains a selective additive consisting essentially of first and second components; said first component being a component selected from the group consisting of hydroxyacetic acid, carboxylic acids and hydroxydicarboxylic acids; said second component being a compound selected from the group consisting of triethanolamine and alcohols.

10. The process of claim 9, wherein:

the concentration of said additive in said anodizing electrolyte is in the range of 4–10% by volume;

said carboxylic and hydroxydicarboxylic acids have carboxyl groups in the first and second positions and include aspartic acid, lactic acid, glycine, succinic acid and glutaric acid; and said alcohols are heavy complex alcohols and include glycerin, mannitol, and sorbital.

11. The process of claim 10, wherein:

said additive is formed by mixing substantially equal parts of said first and second components;

said first component is hydroxyacetic acid;

said second component is glycerin; and the concentration of said additive in said anodizing electrolyte is in the range of 5–7% by volume.

12. The process of claim 8, wherein air and carbon dioxide are injected into said anodizing electrolyte to enhance the oxygen containing foam formed by said surfactant.

13. The process of claim 8, wherein: the series of electrical pulses of the same polarity making up said anodizing current in each repeated anodization are selected substantially identical portions of an AC voltage signal; and the power and RMS voltage level of said pulses from one anodization to the next is controlled by selectively controlling the portions of said AC voltage signals generating said anodizing current in each repeated anodization.

14. The process of claim 1, wherein: said anodizing electrolyte contains a selective additive consisting essentially of first and second components; said first component being a component selected from the group consisting of hydroxyacetic acid, carboxylic acids and hydroxydicarboxylic acids; said second component being a compound selected from the group consisting of triethanolamine and alcohols.

15. The process of claim 14, wherein:

the concentration of said additive in said anodizing electrolyte is in the range of 4–10% by volume;

said carboxylic and hydroxydicarboxylic acids have carboxyl groups in the first and second positions and include aspartic acid, lactic acid, glycine, succinic acid and glutaric acid; and said alcohols are heavy complex alcohols and include glycerin, mannitol, and sorbital.

16. The process of claim 15, wherein:

said additive is formed by mixing substantially equal parts of said first and second components;

said first component is hydroxyacetic acid;

said second component is glycerin; and the concentration of said additive in said anodizing electrolyte is in the range of 5–7% by volume.

17. The process of claim 1, wherein said continuous process includes the following sequential steps:

cleaning the surface of said part of foreign matter and oxide coatings;

rinsing the surface of said part;

repeatedly hard anodizing the surface of said part by the process of claim 1 and rinsing same a plurality of times to establish a hard anodic coating of predetermined thickness thereon; and drying the surface of said part.

18. The process of claim 17, wherein: the series of electrical pulses of the same polarity making up said anodizing current in each repeated anodization are selected substantially identical portions of the same AC voltage signal; and the power and RMS voltage level of said pulses from one anodization to the next is controlled by selectively controlling the portions of said AC voltage signal generating said anodizing current in each repeated anodization.

19. The process of claim 1, wherein air and carbon dioxide are injected into said anodizing electrolyte to enhance the oxygen containing foam formed by said surfactant.

20. The process of claim 1, wherein the series of electrical pulses of the same polarity making up said anodizing current are selected substantially identical portions of an AC voltage signal.

21. A process for anodizing the outer periphery of an anodizable part, comprising: utilizing an anodizing electrolyte containing a surfactant compatible therewith; defining a substantially linear path of travel as an anodizing region by spraying a plurality of jets of said anodizing electrolyte containing said surfactant towards said path of travel from circumferentially spaced apart points therearound to form completely around and over the outer peripheral surface of said part as same is transferred along said path of travel an unbroken envelope of anodizing electrolyte and an oxygen containing foam; and causing an anodizing current to flow through said unbroken electrolyte envelope and cooperating oxygen containing foam, said anodizing current being formed by a series of electrical pulses of the same polarity the duration and magnitude of which are selectively controlled to establish an anodizing current density over said outer peripheral surface having a predetermined average RMS value thereby to produce a hard, thick and uniform anodic coating on said outer peripheral surface.

22. The process of claim 21, wherein said anodizing electrolyte contains a selected additive consisting essentially of first and second components, said first component is a compound selected from the group consisting of hydroxyacetic acid, carboxylic acids, and hydroxydicarboxylic acids, said second component is a compound selected from the group consisting of triethanolamine and alcohols.

23. The process of claim 22, wherein:

said anodizing electrolyte is dilute sulfuric acid and said surfactant is a lignin wood sulfonate;

said anodizing electrolyte contains 15–25% sulfuric acid by volume and 3–10% of said lignin wood sulfonate solution by volume, said lignin wood sulfonate solution being formed by mixing lignin wood sulfonate concentrate with water in the approximate ratio of 100 grams of said concentrate to each gallon of water; and the concentration of said additive in said anodizing electrolyte is in the range of 4–10% by volume; said carboxylic and hydroxydicarboxylic acids having carboxyl groups in the first and second positions and including aspartic acid, lactic acid, glycine, succinic acid and glutaric acid; and said alcohols being heavy complex alcohols and including glycerin, mannitol, and sorbitol.

24. The process of claim 23, wherein air and carbon dioxide are injected into said anodizing electrolyte to enhance the oxygen containing foam formed by said surfactant.

25. The process of claim 21, wherein said anodizing electrolyte is dilute sulfuric acid and said surfactant is a lignin wood sulfonate.

26. A process for hard anodizing the surface of an anodizable part, comprising: utilizing an anodizing electrolyte containing a surfactant compatible therewith; spraying said surface with said anodizing electrolyte containing said surfactant to form across said surface an unbroken envelope of anodizing electrolyte and an oxygen containing foam; and causing an anodizing current formed by a series of selectively controlled electrical pulses of the same polarity to flow through the unbroken electrolyte envelope and oxygen containing foam to produce a hard anodic coating on said surface.

27. The process of claim 26 wherein: said anodizing electrolyte contains a selected additive consisting essentially of first and second components, said first component being a compound selected from the group consisting of hydroxyacetic acid, carboxylic acids and hydroxydicarboxylic acids, said second component being a compound selected from the group consisting of triethanolamine and alcohols.

28. The process of claim 27, wherein:

said anodizing electrolyte is dilute sulfuric acid and said surfactant is a lignin wood sulfonate;

said anodizing electrolyte contains 15–25% sulfuric acid by volume and 3–10% of said lignin wood sulfonate solution by volume; and the concentration of said additive in said anodizing electrolyte is in the range of 4–10% by volume.

29. The process of claim 26, wherein air and carbon dioxide are injected into said anodizing electrolyte being sprayed to enhance the oxygen containing foam.

30. The method of anodizing an anodizable part, comprising placing said part in a selected anodizing electrolyte while causing a series of electrical pulses of the same polarity to flow as an anodizing current through said anodizing electrolyte, said anodizing electrolyte containing a selected additive consisting essentially of first and second components, said first component being a compound selected from the group consisting of hydroxyacetic acid, carboxylic acids and hydroxydicarboxylic acids, said second component being a compound selected from the group consisting of triethanolamine and alcohols.

31. The method of claim 30, wherein:

the concentration of said additive in said anodizing electrolyte is in the range of 4–10% by volume; said carboxylic and hydroxydicarboxylic acids having carboxyl groups in the first and second positions and including aspartic acid, lactic acid, glycine, succinic acid and glutaric acid; and said alcohols being heavy complex alcohols and including glycerin, mannitol, and sorbital.

32. The method of claim 30, wherein said selected anodizing electrolyte contains a compatible surfactant.

33. The method of claim 30, wherein the duration and magnitude of said electrical pulses is selectively controlled to establish an anodizing current density over said surface having a predetermined average RMS value.

34. The method of anodizing an anodizable part, comprising placing said part in an selected anodizing electrolyte while causing a series of electrical pulses of the same polarity to flow as an anodizing current through said anodizing electrolyte, said selected anodizing electrolyte being dilute sulfuric acid and containing a compatible surfactant effective to form an oxygen foam over said part, said anodizing electrolyte also containing a selected additive consisting essentially of first and second components, said first component being a compound selected from the group consisting of hydroxyacetic acid, carboxylic acids and hydroxydicarboxylic acids, said second component being a compound selected from the group consisting of triethanolamine and alcohols.

35. The method of claim 34, wherein said surfactant is a lignin wood sulfonate.

36. The method of claim 35, wherein:

said anodizing electrolyte contains 15–25% sulfuric acid by volume and 3–10% of said lignin wood sulfonate solution by volume, said lignin wood sulfonate solution being formed by mixing lignin wood sulfonate concentrate with water in the approximate ratio of 100 grams of said concentrate to each gallon of water; and the concentration of said additive in said anodizing electrolyte is in the range of 4–10% by volume; said carboxylic and hydroxydicarboxylic acids having carboxyl groups in the first and second positions and including aspartic acid, lactic acid, glycine, succinic acid and glutaric acid; and said alcohols being heavy complex alcohols and including glycerin, mannitol, and sorbital.

37. The method of claim 35, wherein air and carbon dioxide are injected into said anodizing electrolyte to enhance the oxygen containing foam formed by said surfactant.

* * * * *